US011627779B2

(12) United States Patent
Sekii

(10) Patent No.: US 11,627,779 B2
(45) Date of Patent: Apr. 18, 2023

(54) LACING MODULE

(71) Applicant: Nidec Corporation, Kyoto (JP)

(72) Inventor: Yoichi Sekii, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 17/542,801

(22) Filed: Dec. 6, 2021

(65) Prior Publication Data

US 2022/0175090 A1 Jun. 9, 2022

(30) Foreign Application Priority Data

Dec. 8, 2020 (JP) ..... JP2020-203338

(51) Int. Cl.
*A43C 1/06* (2006.01)

(52) U.S. Cl.
CPC ..... *A43C 1/06* (2013.01)

(58) Field of Classification Search
CPC ..... A43C 1/06; A43C 1/00; A43C 11/165; A43C 11/008; A43C 11/00; A43C 7/00; A43B 3/34; A43B 11/00
See application file for complete search history.

(56) References Cited

U.S. PATENT DOCUMENTS 4,901,938 A * 2/1990 Cantley ..... B65H 75/44 242/378.1
10,660,405 B2 5/2020 Schneider et al.
11,241,065 B2 * 2/2022 Schneider ..... A43C 11/16
2008/0301919 A1 * 12/2008 Ussher ..... A43B 3/34 24/712.7
2014/0068838 A1 * 3/2014 Beers ..... A43C 1/00 2/243.1
2017/0265579 A1 * 9/2017 Schneider ..... A43B 3/36
2017/0265586 A1 * 9/2017 Schneider ..... A43B 13/14
2017/0265591 A1 * 9/2017 Schneider ..... B65H 59/00
2017/0265594 A1 * 9/2017 Walker ..... A43B 3/44
2018/0199674 A1 * 7/2018 Walker ..... A43B 3/36
2018/0219403 A1 * 8/2018 Schneider ..... H02J 50/10
2018/0343977 A1 * 12/2018 Riccomini ..... F16G 11/00
2021/0118419 A1 * 4/2021 Bock ..... A43C 11/165
2022/0110414 A1 * 4/2022 Sekii ..... A43C 1/00
2022/0110417 A1 * 4/2022 Sekii ..... B65H 75/14
2022/0175091 A1 * 6/2022 Sekii ..... B65H 75/148

* cited by examiner

*Primary Examiner* — Robert Sandy
*Assistant Examiner* — Rowland Do
(74) *Attorney, Agent, or Firm* — Keating & Bennett

(57) ABSTRACT

In a lacing module, one gear of a worm wheel gear and a clutch gear includes a protrusion, and another gear of the worm wheel gear and the clutch gear includes a recess. The worm wheel gear meshes with a worm gear rotatable together with a shaft of a motor. The clutch gear is fixed to a spool shaft portion of a spool around which a string can be wound. The protrusion protrudes in a direction between the one gear and the another gear. The recess is recessed in the direction between the one gear toward and the another gear. At least an end of the protrusion protruding from one gear to the other gear in a vertical direction is fitted into the recess.

20 Claims, 7 Drawing Sheets

LACING MODULE

CROSS-REFERENCE TO RELATED APPLICATIONS

The present application claims priority under 35 U.S.C. § 119 to Japanese Patent Application No. 2020-203338, filed on Dec. 8, 2020, the entire contents of which are incorporated herein by reference.

1. FIELD OF THE INVENTION

The present disclosure relates to a lacing module.

2. BACKGROUND

In the related art, a lacing unit capable of tightening or loosening a shoelace or the like wound around a spool has been known. A lacing engine that drives the spool includes a worm drive unit, a worm gear, and a gear motor. The gear motor rotates the worm gear via the worm drive unit. The worm gear is designed to prevent the reverse driving of the worm drive unit and the gear motor. The worm gear is coupled with a spool shaft, and rotates the spool to wind a string.

However, in the above-described lacing module, it is difficult to rapidly loosen the string. Accordingly, there is a concern that the string cannot be immediately loosened in an emergency such as a failure of the gear motor.

SUMMARY

An example embodiment of a lacing module of the present disclosure includes a spool, a worm gear, a worm wheel gear, and a clutch gear. The spool includes a barrel portion around which a string is able to be wound, and a spool shaft portion that extends along a first axis extending in a vertical direction. The worm gear is rotatable together with a shaft of a motor. The worm wheel gear meshes with the worm gear. The clutch gear is fixed to a radial outer end of the spool shaft portion, and is above the worm wheel gear. The spool shaft portion is rotatable about the first axis together with the barrel portion and the clutch gear. The worm wheel gear includes a first gear through-hole extending along the first axis. The spool shaft portion is inserted into the first gear through-hole. One gear of the worm wheel gear and the clutch gear includes a protrusion, and the other gear includes a recess. The protrusion is on a surface of the one gear opposing another gear of the worm wheel gear and the clutch gear, and protrudes from the one gear to the another gear in the vertical direction. The recess is on a surface of the another gear opposing the one gear, and is recessed from the one gear to the other gear in the vertical direction. At least an end of the protrusion protruding from the one gear to the other gear in the vertical direction is fitted into the recess.

The above and other elements, features, steps, characteristics and advantages of the present disclosure will become more apparent from the following detailed description of the example embodiments with reference to the attached drawings.

DETAILED DESCRIPTION

Figure 1:
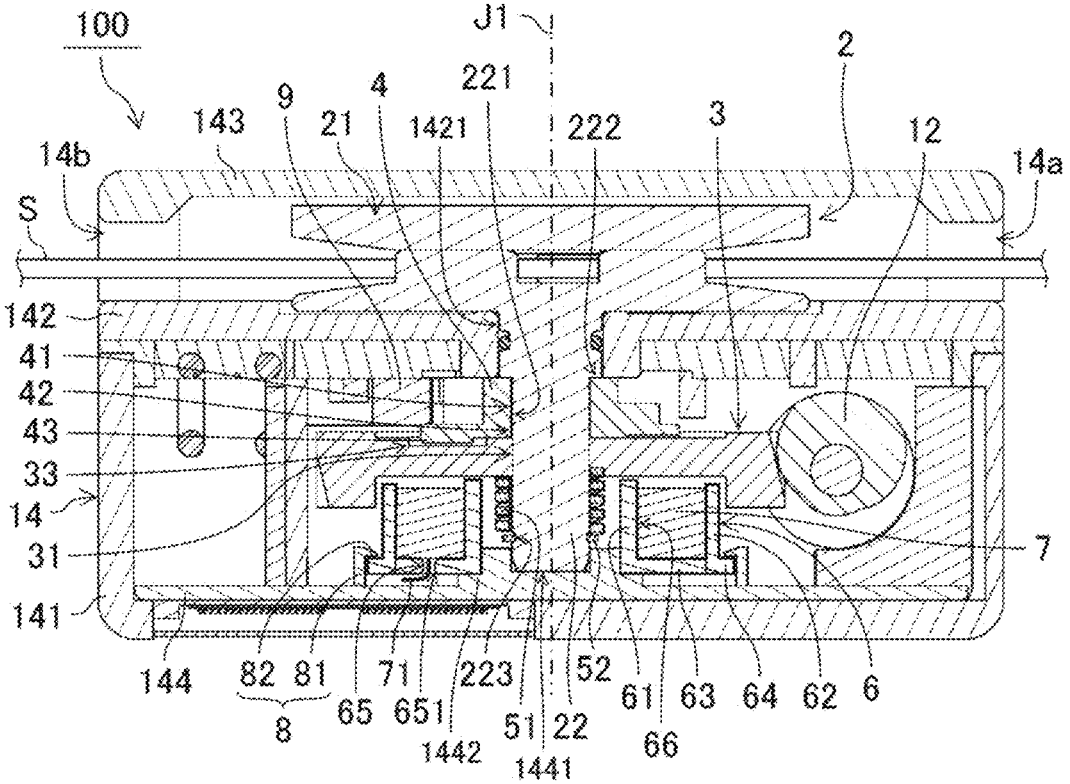
FIG. 1 is a cross-sectional view illustrating a configuration of a lacing module according to an illustrative example embodiment of the present disclosure.

Illustrative example embodiments of the present disclosure will be described below with reference to the drawings.

Note that, in the present specification, a direction in which a first axis J1 of a spool 2 to be described later extends in a lacing module 100 is referred to as a "vertical direction". In the vertical direction, an orientation from a first housing 141 to a third housing 143 to be described later is referred to as an "upper side", and an orientation from the third housing 143 to the first housing 141 is referred to as a "lower side". In each component, an upper side end is referred to as an "upper end" and a lower side end is referred to as a "lower end". Among surfaces of each component, a surface facing the upper side is referred to as an "upper surface", and a surface facing the lower side is referred to as a "lower surface".

A direction orthogonal to a predetermined axis is referred to as a "radial direction". In the radial direction, an orientation approaching an axis is referred to as a "radial inner side", and an orientation separating from the axis is referred to as a "radial outer side". In each component, an end on the radial inner side is referred to as a "radial inner end", and an end on the radial outer side is referred to as a "radial outer end". Among side surfaces of each component, a side surface facing the radial outer side is referred to as a "radial inner surface", and a side surface facing the radial outer side is referred to as a "radial outer surface".

A rotation direction about a predetermined axis is referred to as a "circumferential direction". In each component, an end in the circumferential direction is referred to as a "circumferential end". One orientation in the circumferential direction is referred to as "one circumferential side", and the other orientation in the circumferential direction is referred to as "the other circumferential side". In each component, an end on one circumferential side is referred to as "one circumferential end", and an end on the other circumferential side is referred to as "the other circumferential end".

Among side surfaces of each component, a side surface facing the circumferential direction is referred to as a "circumferential side surface". A side surface facing the one circumferential side is referred to as "one circumferential side surface", and a side surface facing the other circumferential side is referred to as "the other circumferential side surface".

In the present specification, an "annular shape" includes not only a shape continuously connected without any cut along the entire circumferential direction about a predetermined axis but also a shape having one or more cuts in a part of the entire circumference direction about the predetermined axis. The annular shape also includes a shape that draws a closed curve on a curved surface that intersects with a predetermined axis as the center.

In a positional relationship between any one element and the other elements of an azimuth, a line, and a surface, "parallel" includes not only a state in which these elements endlessly extend without intersecting at all but also a state in which these elements are substantially parallel. "Perpendicular" includes not only a state in which these elements intersect each other at 90 degrees, but also a state in which these elements are substantially perpendicular. That is, "parallel" and "perpendicular" each include a state in which the positional relationship between these elements has an angular deviation that does not depart from the gist of the present disclosure.

Note that, these terms are names used merely for description, and are not intended to limit actual positional relationships, directions, names, and the like.

Figure 2:
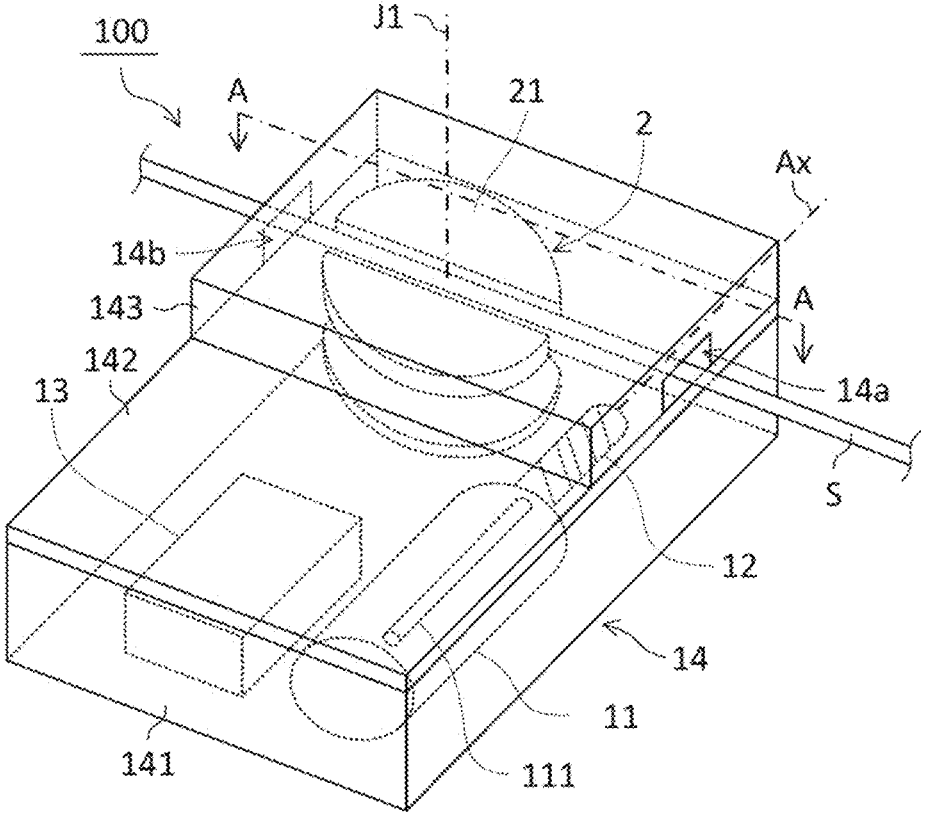
FIG. 2 is a perspective view illustrating a schematic configuration of the lacing module.
Figure 3:
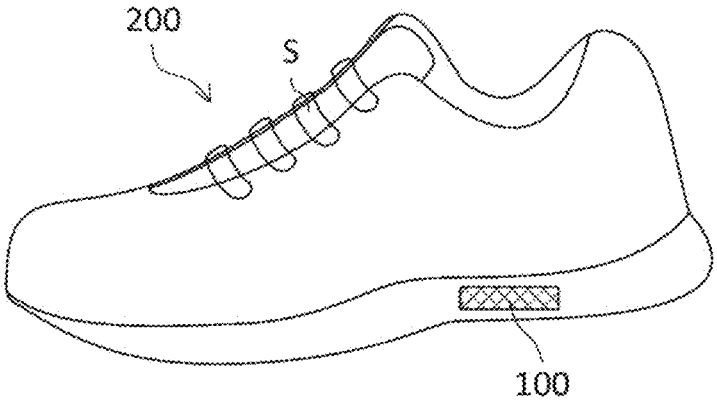
FIG. 3 illustrates an example of the use of the lacing module.

FIG. 1 is a cross-sectional view illustrating a configuration of the lacing module 100 according to the example embodiment. FIG. 2 is a perspective view illustrating a schematic configuration of lacing module 100. FIG. 3 illustrates an example of the use of the lacing module 100. Note that, FIG. 1 illustrates a cross section of the lacing module 100 along a dashed dotted line A-A in FIG. 2.

The lacing module 100 can electrically wind a string S around the spool 2 to be described later or unwind the string from the spool 2. In the present example embodiment, as illustrated in FIG. 3, the lacing module 100 is mounted on footwear 200 such as an exercise shoe, and can tighten or loosen a shoelace (that is, string S) of footwear 200. Note that, the lacing module 100 is not limited to this example. For example, the lacing module 100 can be mounted on an article for winding, releasing, tightening, loosening, and the like of the string S. For example, the lacing module 100 can also be used as a packing bag such as a backpack that closes an outlet by tightening the string S, and a fixture such as an orthopedic cast that is attached by tightening the string S.

The lacing module 100 includes a motor 11, a worm gear 12, a battery 13, a housing 14, a spool 2, a worm wheel gear 3, a clutch gear 4, an elastic portion 51, a metal fitting 52, a yoke 6, a coil 7, a holder 8, and a limiting gear 9.

The motor 11 is electrically connected to the battery 13. A shaft 111 of the motor 11 rotates in one circumferential direction or the other circumferential side about a rotation axis Ax by a current supplied from the battery 13.

The worm gear 12 extends along the rotation axis Ax and is coupled with the shaft 111 of the motor 11. As described above, the lacing module 100 includes the worm gear 12. The worm gear 12 is rotatable together with the shaft 111 of the motor 11. The worm gear 12 is coupled with a spool shaft portion 22, which will be described later, of the spool 2 via the worm wheel gear 3. The worm gear 12 rotates in the circumferential direction about the rotation axis Ax by the driving of the motor 11. The spool 2 rotates in the circumferential direction about the first axis J1 in conjunction with the rotation of the worm gear 12. For example, when the shaft 111 of the motor 11 rotates in one circumferential direction about the rotation axis Ax, the spool 2 rotates in one circumferential direction about the first axis J1, and thus, the string S is wound around the spool 2. On the other hand, when the shaft 111 of the motor 11 rotates in the other circumferential side about the rotation axis Ax, the spool 2 reversely rotates in the other circumferential side about the first axis J1, and thus, the string S is rewound and released from the spool 2.

The housing 14 houses the motor 11, the worm gear 12, the battery 13, the spool 2, the worm wheel gear 3, the clutch gear 4, the elastic portion 51, the metal fitting 52, the yoke 6, the coil 7, the holder 8, the limiting gear 9, and the like therein. A draw-out port 14*a* is disposed on a side surface of the housing 14. A draw-out port 14*b* is disposed on the other side surface of the housing 14. The string S is drawn out of the housing 14 through the draw-out ports 14*a* and 14*b*.

The housing 14 includes a first housing 141, a second housing 142, a third housing 143, and a plate portion 144. The first housing 141 is a box of which an upper end is opened. The motor 11, the worm gear 12, the battery 13, the spool shaft portion 22, the worm wheel gear 3, the clutch gear 4, the elastic portion 51, the metal fitting 52, the yoke 6, the coil 7, the holder 8, the limiting gear 9, and the like are housed in the first housing 141. The second housing 142 has a plate shape and covers the upper end of the first housing 141. The second housing 142 has an opening 1421 penetrating the second housing 142 in the vertical direction. The spool shaft portion 22 is inserted into the opening 1421 as will be described later. The third housing 143 has a covered cylindrical shape with a lower end opened, and covers a region including the opening 1421 on an upper surface of the second housing 142. The draw-out ports 14*a* and 14*b* are disposed on a side surface of the third housing 143. The plate portion 144 is disposed below the yoke 6 and expands in the radial direction about the first axis J1. The lacing module 100 includes the plate portion 144. In the present example embodiment, the plate portion 144 is disposed on a bottom surface of the first housing 141. The plate portion 144 includes a receiving hole 1441 and a yoke support portion 1442. The receiving hole 1441 and the yoke support portion 1442 are disposed on an upper surface of the plate portion 144. The receiving hole 1441 is recessed downward to house a lower end of the spool shaft portion 22. The yoke support portion 1442 supports the yoke 6, and supports a radial inner end of a lower end of the yoke 6 in FIG. 1. Note that, the plate portion 144 is not limited to the example of FIG. 1, and may be a part of the first housing 141.

Figure 4:
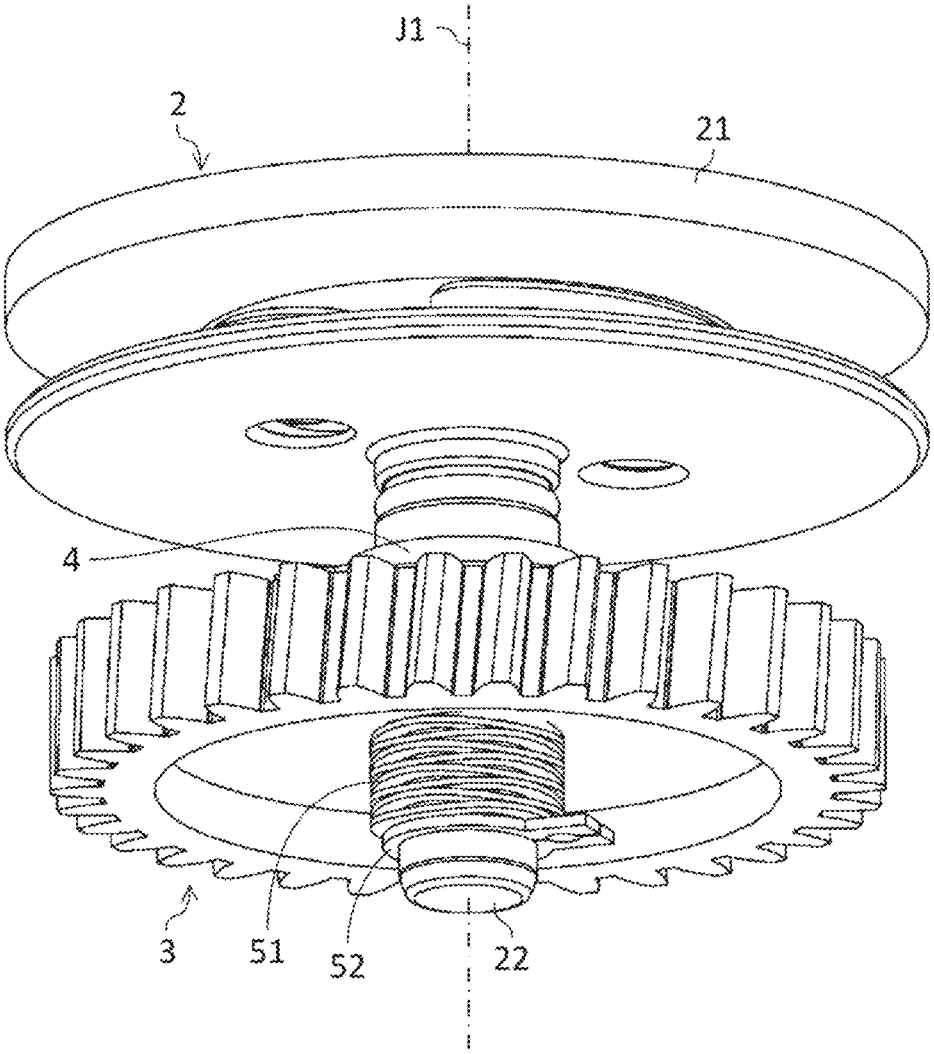
FIG. 4 is a perspective view of a spool assembly according to an illustrative example embodiment of the present disclosure in which a worm wheel gear, a clutch gear, and the like are attached to a spool.
Figure 5:
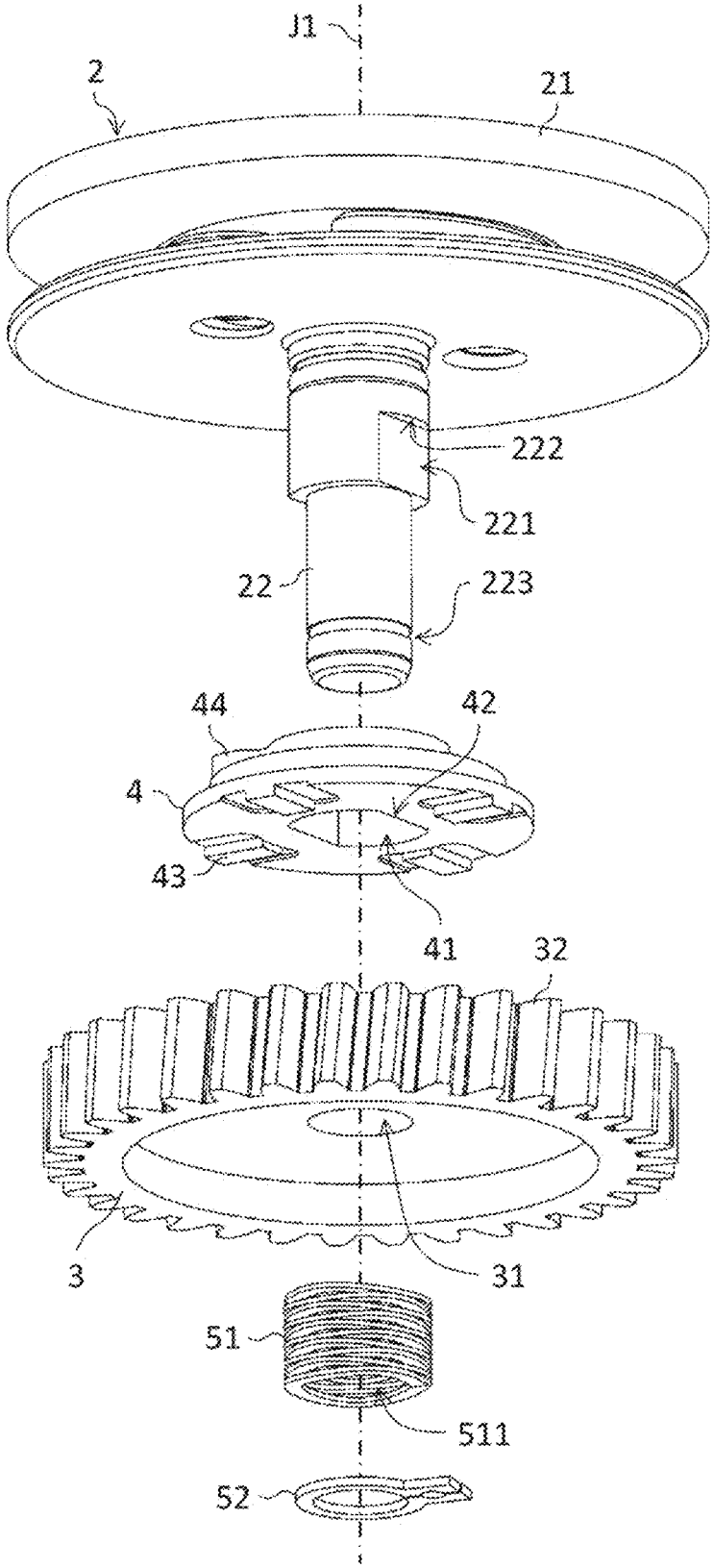
FIG. 5 is an exploded perspective view of the spool assembly.

Next, the spool 2 will be described with reference to FIGS. 1 and 4 to 5. FIG. 4 is a perspective view of a spool assembly in which the worm wheel gear 3, the clutch gear 4, and the like are attached to the spool 2. FIG. 5 is an exploded perspective view of the spool assembly.

As described above, the lacing module 100 includes the spool 2. The spool 2 includes a barrel portion 21 around which the string S can be wound and the spool shaft portion 22. The spool shaft portion 22 extends along the first axis J1 extending in the vertical direction.

The barrel portion 21 is connected to an upper end of the spool shaft portion 22 and is rotatable together with the spool shaft portion 22. The barrel portion 21 is housed in the third housing 143. An upper end of the barrel portion 21 faces a top surface inside the third housing 143 in the vertical direction. A lower end of the barrel portion 21 faces the upper surface of the second housing 142 in the vertical direction. Accordingly, the movement of the spool 2 in the vertical direction is suppressed.

The spool shaft portion 22 is inserted into the opening 1421 of the second housing 142 and is fitted into the opening 1421 via an O-ring (reference sign is omitted). Accordingly, the spool shaft portion 22 is held by the second housing 142 so as to be rotatable about the first axis J1. The spool shaft portion 22 is rotatable about the first axis J1 together with the barrel portion 21 and the clutch gear 4.

The spool shaft portion 22 has a first flat surface portion 221 (see FIG. 1 and FIG. 5 to be described later). The first flat surface portion 221 is parallel to the vertical direction and is disposed on the radial outer surface of the spool shaft portion 22.

The spool shaft portion 22 has a contact surface portion 222 (see FIG. 1 and FIG. 5 to be described later). The contact surface portion 222 is in contact with an upper end of the clutch gear 4. The contact surface portion 222 is perpendicular to the vertical direction and is disposed above the first flat surface portion 221. The contact surface portion 222 is disposed on the radial outer surface of the spool shaft portion 22 and expands to the radial outer side from an upper end of the first flat surface portion 221 in the present example embodiment. By doing this, as will be described later, when the spool shaft portion 22 is inserted into a second gear through-hole 41 of the clutch gear 4, the clutch gear 4 can be easily positioned with respect to the spool shaft portion 22 in the vertical direction.

The spool shaft portion 22 has a groove 223 (see FIG. 1 and FIG. 5 to be described later). The groove 223 is recessed to the radial inner side, extends in the circumferential direction, and is disposed on the radial outer surface of the spool shaft portion 22. The groove 223 is disposed below the elastic portion 51 in a lower portion of the spool shaft portion 22.

Figure 6:
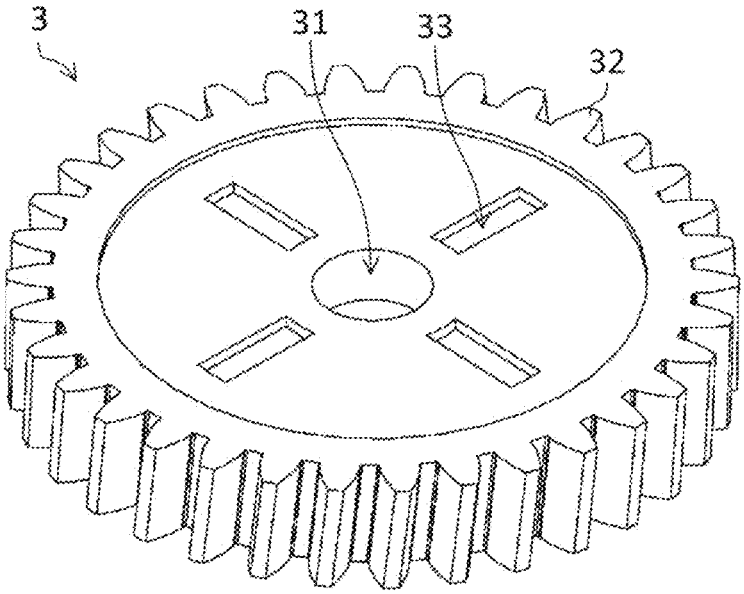
FIG. 6 is a top view of the worm wheel gear.

Next, the worm wheel gear 3 will be described with reference to FIGS. 1 and 4 to 6. FIG. 6 is a top view of the worm wheel gear 3.

The worm wheel gear 3 is disposed at a radial outer end of the spool shaft portion 22 and extends to the radial outer side from the radial outer end of the spool shaft portion 22. In other words, the worm wheel gear 3 has the first gear through-hole 31 extending along the first axis J1. The spool shaft portion 22 is inserted into the first gear through-hole 31. An inner peripheral surface of the first gear through-hole 31 faces the radial outer surface of the spool shaft portion 22 with a gap in the radial direction.

As described above, the lacing module 100 includes the worm wheel gear 3. The worm wheel gear 3 meshes with the worm gear 12. Specifically, a plurality of teeth 32 is disposed side by side in the circumferential direction at a radial outer end of the worm wheel gear 3. When the teeth 32 mesh with teeth of the worm gear 12, the worm wheel gear 3 rotates in the circumferential direction about the first axis J1 according to the rotation of the worm gear 12. A material of the worm wheel gear 3 is a magnetic body.

The worm wheel gear 3 has recesses 33. In the present example embodiment, as illustrated in FIGS. 1 and 6, the recesses 33 are disposed on an upper surface of the worm wheel gear 3 and are recessed downward. The plurality of recesses 33 is disposed on the upper surface of the worm wheel gear 3 and is arranged in the circumferential direction about the first axis J1. Note that, the number of recesses 33 is four in FIG. 6, but is not limited to this example. The number of recesses 33 may be a singular number or plural other than four.

Next, the clutch gear 4 will be described with reference to FIGS. 1 and 4 to 5. The clutch gear 4 is disposed above the worm wheel gear 3. As described above, the lacing module 100 includes the clutch gear 4. The clutch gear 4 is fixed to the radial outer end of the spool shaft portion 22 and expands to the radial outer side from the radial outer end of the spool shaft portion 22. In other words, the clutch gear 4 has the second gear through-hole 41 extending along the first axis J1. The spool shaft portion 22 is inserted into the second gear through-hole 41. The inner peripheral surface of the second gear through-hole 41 is in contact with the radial outer surface of the spool shaft portion 22. A lower surface of the clutch gear 4 faces the upper surface of the worm wheel gear 3 in the vertical direction.

The clutch gear 4 further includes a second flat surface portion 42 parallel to the vertical direction. The second flat surface portion 42 is disposed on an inner surface of the second gear through-hole 41. The second flat surface portion 42 faces and is in contact with the first flat surface portion 221 in the radial direction. By doing this, the idling of the clutch gear 4 with respect to the spool shaft portion 22 can be reliably prevented. Since it is not necessary to use a key member when the clutch gear 4 is fixed to the spool shaft portion 22, the number of components of the lacing module 100 can be reduced.

Note that, the spool shaft portion 22 is fitted to the second gear through-hole 41, and the first flat surface portion 221 faces and is in contact with the second flat surface portion 42 in the radial direction. Thus, the clutch gear 4 can be fixed to the spool shaft portion 22. Preferably, bonding such as adhesion using an adhesive, brazing, welding, or the like may be used in combination as means for fixing the clutch gear 4 to the spool shaft portion 22. By doing this, the clutch gear 4 can be more firmly fixed to the spool shaft portion 22.

As illustrated in FIGS. 1 and 5, the clutch gear 4 further includes protrusions 43. The protrusions 43 are disposed on the lower surface of the clutch gear 4 and protrude downward. At least lower ends of the protrusions 43 are detachably fitted in the recesses 33 of the worm wheel gear 3. Due to the fitting between the protrusions and the recesses, the clutch gear 4 is rotatable in the circumferential direction about the first axis J1 together with the worm wheel gear 3. That is, a torque of the worm wheel gear 3 can be transmitted to the clutch gear 4 and can be further transmitted to the spool 2 via the clutch gear 4. Note that, the number of protrusions 43 is four in FIG. 5, but is not limited to this example. The number of protrusions 43 may be a singular number or plural other than four.

In the present example embodiment, all the protrusions 43 are disposed on the lower surface of the clutch gear 4 (see FIG. 5), and all the recesses 33 are disposed on the upper surface of the worm wheel gear 3 (see FIG. 6). However, the present disclosure is not limited to the example of the present example embodiment, and at least one protrusion 43 may be disposed on the upper surface of the worm wheel gear 3, and at least one recess 33 may be disposed on the lower surface of the clutch gear 4.

That is, one gear of the worm wheel gear 3 and the clutch gear 4 may have the protrusions 43 and the other gear may have the recesses 33. In this case, the protrusions 43 are disposed on a surface of the one gear facing the other gear, and protrude in an orientation from the one gear to the other gear in the vertical direction. The recesses 33 are disposed on a surface of the other gear facing the one gear, and are recessed in an orientation from the one gear to the one gear in the vertical direction. At least an end of the protrusion 43 in the orientation from the one gear to the other gear in the vertical direction is fitted into the recess 33.

By fitting the protrusions 43 into the recesses 33, the worm wheel gear 3 can transmit the torque transmitted from the motor 11 to the clutch gear 4 via the worm gear 12. Since the clutch gear 4 is fixed to the spool shaft portion 22, the spool 2 rotates by the torque transmitted from the clutch gear 4, the string S is wound around the barrel portion 21. Thus, tension can be given to the string S. The spool 2 can also loosen the string S wound around the barrel portion 21 and can release the string from the barrel portion 21 by reversely rotating according to the reverse rotation of the motor 11.

When excessive tension acts on the string S, the protrusions 43 can be detached from the recesses 33. Accordingly, the spool 2 can freely rotate and quickly loosen the string S wound around the barrel portion 21. Accordingly, since the tension acting on the string S can be immediately reduced, the damage of the string S can be reduced or prevented, and thus, the lifespan of the string S can be increased. The string S can be immediately loosened by applying external force to the string S. For example, in an emergency or the like, the string S can be immediately drawn out from the spool 2 and can be loosened by strongly pulling the string S.

Figure 7A:
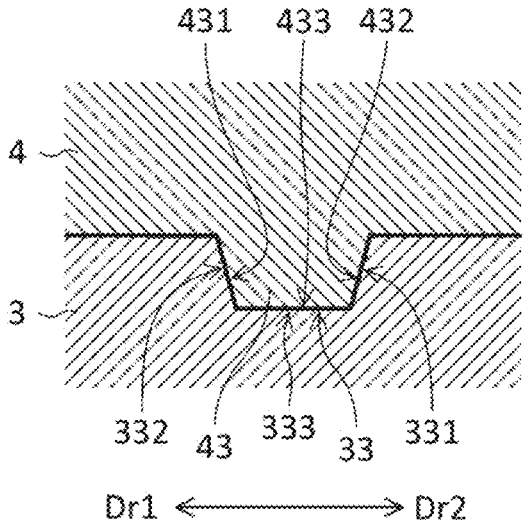
FIG. 7A is a cross-sectional view illustrating an example of fitting of a protrusion to a recess viewed in a radial direction according to an illustrative example embodiment of the present disclosure.
Figure 7B:
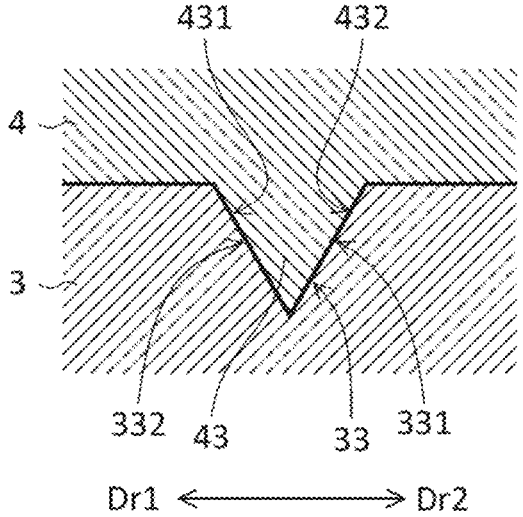
FIG. 7B is a cross-sectional view illustrating another example of the fitting of the protrusion to the recess viewed in the radial direction.

Preferably, the protrusions 43 of one gear of the clutch gear 4 and the worm wheel gear 3 and the recesses 33 of the other gear have tapered shapes as viewed in the radial direction about the first axis J1. As the tapered shapes advance in the orientation from the one gear to the other gear in the vertical direction, widths in a direction perpendicular to the vertical direction and parallel to the radial direction become narrower. FIG. 7A is a cross-sectional view illustrating an example of the fitting of the protrusions 43 to the recesses 33 when viewed from the radial direction. FIG. 7B is a cross-sectional view illustrating another example of the fitting of the protrusions 43 to the recesses 33 when viewed from the radial direction.

For example, in FIGS. 7A and 7B, as viewed in the radial direction about the first axis J1, the widths the tapered shapes of the recess 33 and the protrusion 43 in the direction perpendicular to the vertical direction and parallel to the radial direction become narrower toward the lower side. Specifically, the recess 33 has an inner surface 331 facing at least one circumferential side Dr1 and an inner surface 332 facing at least the other circumferential side Dr2. The protrusion 43 has one circumferential side surface 431 facing at least one circumferential side Dr1 and the other circumferential side surface 432 facing at least the other circumferential side Dr2. The inner surface 332 of the recess 33 and one circumferential side surface 431 of the protrusion 43 face each other in the circumferential direction, obliquely intersect with the vertical direction, and extend to the other circumferential side Dr2 toward the lower side as viewed in the radial direction. The inner surface 331 of the recess 33 and the other circumferential side surface 432 of the protrusion 43 face each other in the circumferential direction, obliquely intersect with the vertical direction, and extend to one circumferential side Dr1 toward the lower side as viewed in the radial direction. Thus, as viewed in the radial direction about the first axis J1, widths of the recess 33 and the protrusion 43 in the direction perpendicular to the vertical direction and parallel to the radial direction become narrower toward the lower side. With such tapered shapes, the protrusion 43 can be reliably detached from the recess 33 when a torque equal to or greater than a predetermined threshold is transmitted to the worm wheel gear 3 and the clutch gear 4. At this time, since the circumferential side surfaces 431 and 432 of the protrusion 43 slide in the orientation from the other gear to the one gear (upward in FIGS. 7A and 7B) in the vertical direction with respect to the inner surfaces 331 and 332 of the recess 33, deformation, breakage, and the like of the recess 33 and the protrusion 43 hardly occur.

More preferably, as viewed in the radial direction about the first axis J1, each of the tapered shapes of the recess 33 and the protrusion 43 is a trapezoidal shape having a flat surface intersecting with the vertical direction at the end in the orientation from the one gear to the other gear in the vertical direction. For example, in FIG. 7A, the inner surfaces 331 and 332, one circumferential side surface 431, and the other circumferential side surface 432 are inclined by about 5° with respect to the vertical direction as viewed in the radial direction about the first axis J1. The recess 33 further includes a bottom surface 333 facing upward. The bottom surface 333 is a flat surface intersecting with the vertical direction, and is perpendicular to the vertical direction in the present example embodiment. As viewed in the radial direction about the first axis J1, one circumferential end of the bottom surface 333 is connected to a lower end of the inner surface 332, and the other circumferential end of the bottom surface 333 is connected to a lower end of the inner surface 331. The protrusion 43 further includes a lower surface 433. The lower surface 433 is a flat surface intersecting with the vertical direction, and is perpendicular to the vertical direction in the present example embodiment. Preferably, as in the present example embodiment, the lower surface 433 is parallel to the bottom surface 333. As viewed in the radial direction about the first axis J1, one circumferential end of the lower surface 433 is connected to a lower end of the one circumferential side surface 431, and the other circumferential end of the lower surface 433 is connected to a lower end of the other circumferential side surface 432. By doing this, it is possible to suppress increases in sizes of the recess 33 and the protrusion 43 in the vertical direction. An upper limit of the torque transmitted to the worm wheel gear 3 and the clutch gear 4 when the protrusion 43 is detached from the recess 33 by the sizes of the recess 33 and the protrusion 43 in the vertical direction can be adjusted. Note that, the present disclosure is not limited to the above example, and the lower surface 433 and the bottom surface 333 may be curved surfaces protruding upward or downward as viewed in the radial direction about the first axis J1. In this case, preferably, the lower surface 433 extends along the bottom surface 333.

Alternatively, more preferably, the tapered shapes of the recess 33 and the protrusion 43 are triangular shapes each having a corner at the end in the orientation from the one gear to the other gear in the vertical direction as viewed in the radial direction. For example, in FIG. 7B, the inner surfaces 331 and 332, one circumferential side surface 431, and the other circumferential side surface 432 are inclined by about 30° with respect to the vertical direction as viewed in the radial direction about the first axis J1. As viewed in the radial direction about the first axis J1, the lower end of the inner surface 331 of the recess 33 is connected to the lower end of the inner surface 332. As viewed in the radial direction about the first axis J1, the lower end of one circumferential side surface 431 of the protrusion 43 is connected to the lower end of the other circumferential side surface 432. By doing this, the sizes of the recess 33 and the protrusion 43 in the vertical direction can be increased as compared with the case where the tapered shapes of the recess and the protrusion are the trapezoidal shapes. Accordingly, the upper limit of the torque transmitted to the clutch gear 4 and the worm wheel gear 3 when the protrusion 43 is detached from the recess 33 can be adjusted to be larger.

More preferably, one circumferential side surface 431 of the protrusion 43 is parallel to the inner surface 332 on the one circumferential side Dr1 of the recess 33. The other circumferential side surface 432 of the protrusion 43 is parallel to the inner surface 331 on the other circumferential side Dr2 of the recess 33. By doing this, since the circumferential side surfaces 431 and 432 of the protrusion 43 can be in surface contact with the inner surfaces 332 and 331 of the recess 33 respectively, it is possible to prevent a deviation in pressure acting on both the surfaces of the protrusion. The circumferential side surfaces 431 and 432 of the protrusion 43 further easily slide in the orientation from the other gear to the one gear in the vertical direction (upward in FIGS. 7A and 7B) with respect to the inner surfaces 331 and 332 of the recess 33. Accordingly, deformation, breakage, and the like of the recess 33 and the protrusion 43 further hardly occur.

The clutch gear 4 further includes a plurality of first teeth 44. The clutch gear 4 is an intermittent gear in which the plurality of first teeth 44 arranged in the circumferential direction is disposed in a partial region of the radial outer surface in the circumferential direction. That is, the first teeth 44 are disposed in the circumferential direction at predetermined intervals in the partial region, but are not disposed in a region other than the partial region. Note that, the number of first teeth 44 is two in the present example embodiment (see FIG. 9 to be described later). However, the present disclosure is not limited to this example, and the number of first teeth 44 may be three or more.

Next, the elastic portion 51 will be described with reference to FIGS. 1 and 4 to 5. The elastic portion 51 is disposed below the worm wheel gear 3. The elastic portion 51 has an opening 511 penetrating in the vertical direction. The spool shaft portion 22 is inserted into the opening 511 of the elastic portion 51. In other words, the elastic portion 51 is disposed on the radial outer side from the spool shaft portion 22. As described above, the lacing module 100 includes the elastic portion 51. The elastic portion 51 is in contact with a lower end of the worm wheel gear 3 to apply a load directed to the clutch gear 4 to the worm wheel gear 3. Due to the above load applied to the worm wheel gear 3 by the elastic portion 51, the protrusion 43 can be prevented from easily being detached from the recess 33. The tension acting on the string S when the protrusion 43 is detached from the recess 33 can be adjusted by adjusting the above load. That is, the upper limit of the tension acting on the string S can be adjusted.

The elastic portion 51 is a spring coil in the present example embodiment. However, the elastic portion 51 is not limited to this example. The elastic portion 51 may be a member having high elasticity in at least the vertical direction. The elastic portion 51 may be, for example, a leaf spring or a rubber member.

Next, the metal fitting 52 will be described with reference to FIGS. 1 and 4 to 5. The metal fitting 52 has an annular shape surrounding the first axis J1 and is in contact with a lower end of the elastic portion 51. As described above, the lacing module 100 includes the metal fitting 52. The spool shaft portion 22 is inserted into the metal fitting 52. A radial inner end of the metal fitting 52 is housed in the groove 223 of the spool shaft portion 22. By doing this, the metal fitting 52 can be easily attached to the spool shaft portion 22. The metal fitting 52 can uniformly support the lower end of the elastic portion 51 in the circumferential direction by attaching the metal fitting 52. Accordingly, the elastic portion 51 can apply a uniform load to the worm wheel gear 3 in the circumferential direction about the spool shaft portion 22.

Figure 8:
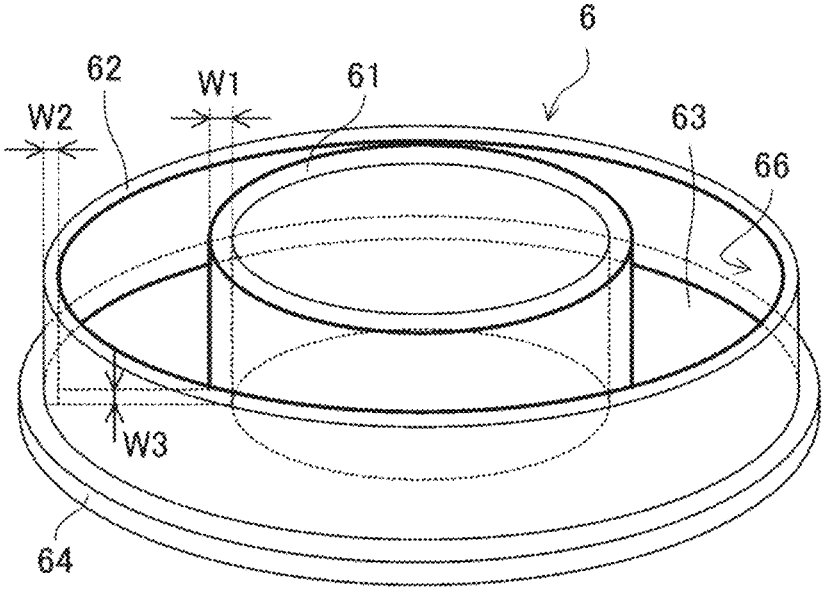
FIG. 8 is a perspective view illustrating a configuration example of a yoke according to an illustrative example embodiment of the present disclosure.

Next, the yoke 6 and the coil 7 will be described with reference to FIGS. 1 and 8. FIG. 8 is a perspective view illustrating a configuration example of the yoke 6.

As described above, the lacing module 100 includes the yoke 6 and the coil 7. The coil 7 extends in the circumferential direction about the first axis J1. Each of the coil 7 and the yoke 6 is disposed below the worm wheel gear 3. The yoke 6 is a magnetic body and faces the worm wheel gear 3 in the vertical direction. The yoke 6 forms a magnetic circuit through which a magnetic flux generated by energization of the coil 7 passes together with the worm wheel gear 3.

The yoke 6 is an annular box body surrounding the first axis J1 and having an open upper end. The yoke 6 extends in the circumferential direction about the first axis J1 and houses the coil 7 therein. Specifically, the yoke 6 includes a first yoke portion 61, a second yoke portion 62, and a third yoke portion 63. The first yoke portion 61 is disposed on the radial inner side from the coil 7. The second yoke portion 62 is disposed on the radial outer side from the coil 7. The third yoke portion 63 is disposed below the coil 7 and extends in the circumferential direction. Each of the first yoke portion 61 and the second yoke portion 62 has a cylindrical shape extending in the vertical direction. A lower end of the first yoke portion 61 and a lower end of the second yoke portion 62 are connected to the third yoke portion 63.

With the structure of the yoke 6 as described above, a magnetic circuit surrounding the coil 7 through the worm wheel gear 3 and the yoke 6 is formed by applying a current to the coil 7, and thus, the worm wheel gear 3 can be attracted downward. Accordingly, for example, it is possible to easily loosen the string S by detaching the protrusion 43 from the recess 33 at an arbitrary timing according to an operation input of a user or a detection result of a sensor that detects the tension of the string S.

The yoke 6 further includes a yoke flange portion 64. The yoke flange portion 64 expands to the radial outer side from a radial outer end of the second yoke portion 62. The yoke flange portion 64 is engaged with the holder 8, to be described later, of the housing 14.

Preferably, the first yoke portion 61 is a different portion of the same member as the third yoke portion 63 (see, for example, FIGS. 1 and 8). The first yoke portion 61 is formed integrally with the third yoke portion 63, and thus, the coil 7 disposed on the radial outer side from the first yoke portion 61 can be prevented from being detached downward. Accordingly, the coil 7 is easily attached. For example, the coil 7 can be easily formed by winding a conductive wire around the first yoke portion 61. However, the present disclosure is not limited to this example, and the first yoke portion 61 may be a member different from the third yoke portion 63.

Preferably, an upper end of one yoke portion of the first yoke portion 61 and the second yoke portion 62 is above an upper end of the other yoke portion. In the present example embodiment, the upper end of the first yoke portion 61 is above the upper end of the second yoke portion 62 (see, for example, FIGS. 1 and 8). However, the present disclosure is not limited to this example, and the upper end of the second yoke portion 62 may be above the upper end of the first yoke portion 61. By doing this, the one yoke portion can be brought closer to the worm wheel gear 3 than the other yoke portion. Thus, a magnetic force acting between the one yoke portion and the worm wheel gear 3 can be stronger. Accordingly, the worm wheel gear 3 is easily attracted downward as compared with the case where a position of the upper end of the first yoke portion 61 in the vertical direction is the same as a position of the upper end of the second yoke portion 62 in the vertical direction. Note that, this example does not exclude a configuration in which the position of the upper end of the first yoke portion 61 in the vertical direction is the same as the position of the upper end of the second yoke portion 62 in the vertical direction.

More preferably, a width of the one yoke portion in the radial direction is equal to or greater than a width W3 of the third yoke portion 63 in the vertical direction. That is, one of a width W1 of the first yoke portion 61 in the radial direction and a width W2 of the second yoke portion 62 in the radial direction is equal to or greater than the width W3 of the third yoke portion 63 in the vertical direction. In the present example embodiment, as illustrated in FIG. 8, $W3 \leq W1$ is satisfied. However, the present disclosure is not limited to this example, and $W3 \leq W2$ may be satisfied. By doing this, it is possible to further widen a cross-sectional area through which the magnetic flux of the magnetic circuit passes between the one yoke portion and the worm wheel gear 3 where a stronger magnetic force acts. Accordingly, the worm wheel gear 3 is more easily attracted downward by the magnetic circuit. Note that, this example does not exclude the configuration of $W1=W2=W3$ and the configuration of $W1<W3$ and $W2<W3$.

The third yoke portion 63 has at least one yoke through-hole 65. The yoke through-hole 65 penetrates the third yoke portion 63 in the vertical direction. By doing this, a connection line 71 of the coil 7 can be drawn out of the yoke 6 through the yoke through-hole 65 without causing damage due to contact with other members such as the worm wheel gear 3, occurrence of variation in magnetic distribution between the worm wheel gear 3 and the yoke 6, and the like. The forming of the yoke through-hole 65 in the third yoke portion 63 is easier than the forming of a through-hole in the first yoke portion 61 or the second yoke portion 62. Accordingly, the yoke through-hole 65 can be easily formed. Note that, the present disclosure is not limited to this example, and the yoke through-hole 65 may be disposed in at least one of the first yoke portion 61 and the second yoke portion 62. In this case, the yoke through-hole 65 is preferably disposed below these yoke portions. By doing this, the connection line 71 is hardly in contact with the worm wheel gear 3.

Preferably, the third yoke portion 63 further includes a chamfered portion 651. The chamfered portion 651 is disposed in at least one end of an upper end and a lower end of an inner surface of the yoke through-hole 65. Specifically, in a peripheral edge of the third yoke portion 63 at the one end, so-called R chamfering (round chamfering) for forming a curved surface between the inner surface and the end surface or so-called C chamfering (beveling) for diagonally cutting an angle of the corner is performed on a corner formed by the inner surface of the yoke through-hole 65 and an end surface of the third yoke portion 63 in the vertical direction. For example, in the present example embodiment, the chamfered portion 651 is C-chamfered at both the upper end and the lower end of the yoke through-hole 65 (see FIG. 1). A sharp corner can be prevented from being formed in the at least one end of the inner surface of the yoke through-hole 65 by disposing the chamfered portion 651. Accordingly, it is possible to avoid the occurrence of a problem caused by contact with the sharp corner. For example, insulation between the connection line 71 and the yoke 6 or the like can be ensured. For example, when a coating film such as an insulating film 66 to be described later is formed on the third yoke portion 63, a coating film having a sufficient thickness can also be formed on the at least one end of the inner surface of the yoke through-hole 65.

Next, the yoke 6 has the insulating film 66 having electrical insulation. In other words, the lacing module 100 further includes the insulating film 66 having electrical insulation. The insulating film 66 covers at least a region facing the coil 7 on a surface of the yoke 6. For example, in the present example embodiment, the insulating film 66 is formed on at least the radial outer surface of the first yoke portion 61, the radial inner surface of the second yoke portion 62, and an upper surface of the third yoke portion 63. Preferably, the insulating film 66 covers the entire surface of the yoke 6. By doing this, the electrical insulation between the yoke 6 and the coil 7 can be ensured. In the present example embodiment, an epoxy resin is used as a material of the insulating film 66. However, the present disclosure is not limited to this example, and other resin materials or insulating materials such as ceramic may be used.

Next, in the present example embodiment, an air core coil in which conductor wires (not illustrated) are bundled in advance into a coil shape is used as the coil 7. An inner diameter of the air core coil is greater than an outer diameter of the first yoke portion 61. Thus, the coil 7 has a gap with the radial outer surface of the first yoke portion 61 in the radial direction. Due to the use of the air core coil, a slight gap is generated between the radial outer surface of the first yoke portion 61 and the coil 7 in the radial direction, but the coil 7 is easily attached. For example, the coil 7 can be disposed after the yoke 6 is attached.

However, the present disclosure is not limited to this example, and the coil 7 may be wound around the radial outer surface of the first yoke portion 61. That is, the coil 7 may include a conductive wire wound around the radial outer surface of the first yoke portion 61. The coil 7 is formed by winding the conductive wire, and thus, the coil 7 can be disposed without the gap with the radial outer surface of the first yoke portion 61 in the radial direction. Accordingly, the magnetic performance of the magnetic circuit formed in the worm wheel gear 3 and the yoke 6 can be improved.

In the vertical direction, a position of an upper end of the coil 7 is at one of the same position as the upper end of the yoke 6 and a position below the upper end of the yoke 6 (see FIG. 1). In other words, in the vertical direction, the position of the upper end of the coil 7 may be at the same position as the upper end of one yoke portion of the first yoke portion 61 and the second yoke portion 62, and the one yoke portion has the upper end positioned higher than the other yoke portion. Preferably, the upper end of the coil 7 is positioned below the upper end of the one yoke portion. More preferably, the upper end of the coil 7 is positioned below the upper end of the first yoke portion 61 and the upper end of the second yoke portion 62. By doing this, the upper end of the coil 7 can be prevented from protruding upward from the upper end of the yoke 6. Accordingly, an interval between the yoke 6 and the worm wheel gear 3 can be further narrowed. Accordingly, the magnetic performance of the magnetic circuit formed in the worm wheel gear 3 and the yoke 6 can be further improved.

Next, the holder 8 will be described with reference to FIG. 1. The holder 8 holds the yoke 6. The lacing module 100 includes at least one holder 8. The holder 8 protrudes upward from the plate portion 144 and engages with the yoke flange portion 64. For example, the holder 8 includes a protruding portion 81 and a claw portion 82. The protruding portion 81 protrudes upward from the upper surface of the plate portion 144. The claw portion 82 protrudes to the radial inner side from a radial inner end of the protruding portion 81. A lower surface of the claw portion 82 is in contact with the upper surface of the yoke flange portion 64. In the present example embodiment, a material of the holder 8 is thermoplastic resin, and the claw portion 82 is engaged with the yoke flange portion 64 by thermal caulking. For example, the claw portion 82 is formed by pressing the upper end of the protruding portion 81 from above to below while being heated and melted. Alternatively, the holder 8 may be engaged with the yoke flange portion 64 by so-called snap-fit. The yoke 6 can be fixed to the plate portion 144 by the engagement between the holder 8 and the yoke flange portion 64. For example, since the fixing can be performed without using a screw or the like, the number of components of the lacing module 100 can be reduced.

Figure 9:
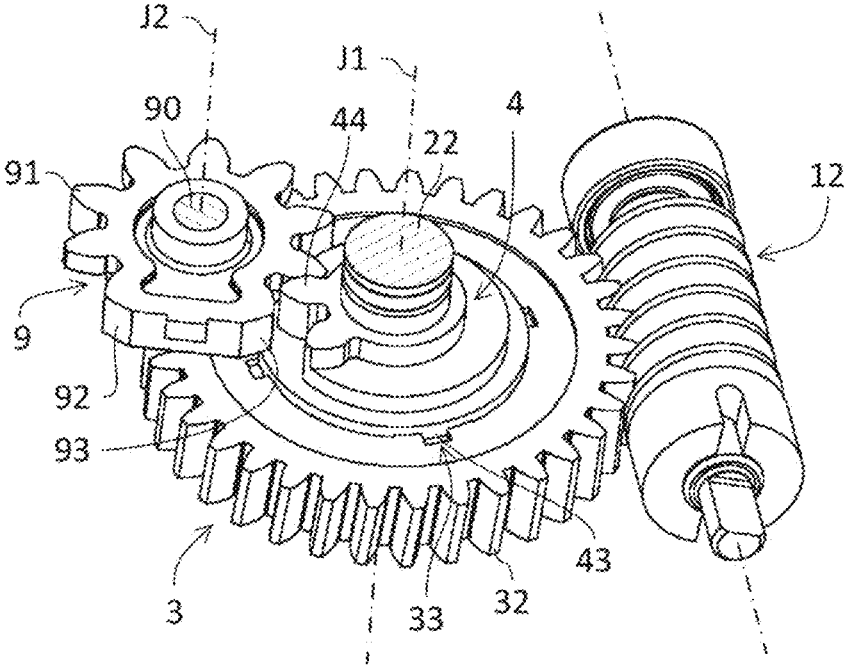
FIG. 9 is a perspective view illustrating engagement of gears according to an illustrative example embodiment of the present disclosure.

Next, the limiting gear 9 will be described with reference to FIGS. 1 and 9. FIG. 9 is a perspective view illustrating engagement of gears.

The limiting gear 9 is rotatable about a second axis J2 parallel to the first axis J1 and meshes with the clutch gear 4. As described above, the lacing module 100 includes the limiting gear 9. As illustrated in FIG. 9, the limiting gear 9 is rotatably supported by a predetermined shaft portion 90 extending in the vertical direction along the second axis J2, and extends to the radial outer side from the shaft portion 90.

The limiting gear 9 includes a plurality of second teeth 91, a first limiting tooth 92, and a second limiting tooth 93. The plurality of second teeth 91 is arranged in the circumferential direction about the second axis J2. The first limiting tooth 92 is arranged adjacent to the second tooth 91 disposed closest to one circumferential side in the circumferential direction. The second limiting tooth 93 is arranged adjacent to the second tooth 91 disposed closest to the other circumferential side in the circumferential direction. The second teeth 91, the first limiting tooth 92, and the second limiting tooth 93 of the limiting gear 9 can mesh with the first teeth 44 of the clutch gear 4. Tooth thicknesses of the first limiting tooth 92 and the second limiting tooth 93 are larger than a width of a tooth groove between the first teeth 44 adjacent in the circumferential direction of the clutch gear 4.

By doing this, the clutch gear 4 can rotate together with the spool 2 while the second teeth 91 of the limiting gear 9 mesh with the first teeth 44 of the clutch gear 4. Accordingly, the spool 2 can wind the string S around the barrel portion 21 or can unwind the string S wound around the barrel portion 21. On the other hand, when the first limiting tooth 92 or the second limiting tooth 93 of the limiting gear 9 meshes with the first tooth 44 of the clutch gear 4, the clutch gear 4 cannot rotate. Thus, the spool 2 cannot wind or unwind the string S. Accordingly, when the limiting gear 9 meshes with the clutch gear 4, it is possible to decide a range in which the lacing module 100 winds the string S and a range in which the lacing module unwinds the string S.

The state in which the first limiting tooth 92 of the limiting gear 9 meshes with the first tooth 44 of the clutch gear 4 can be used as a starting point of the range in which the lacing module 100 winds the string. The state in which the second limiting tooth 93 of the limiting gear 9 meshes with the first tooth 44 of the clutch gear 4 can be used as a starting point of the range in which the lacing module 100 unwinds the string S.

Figure 10:
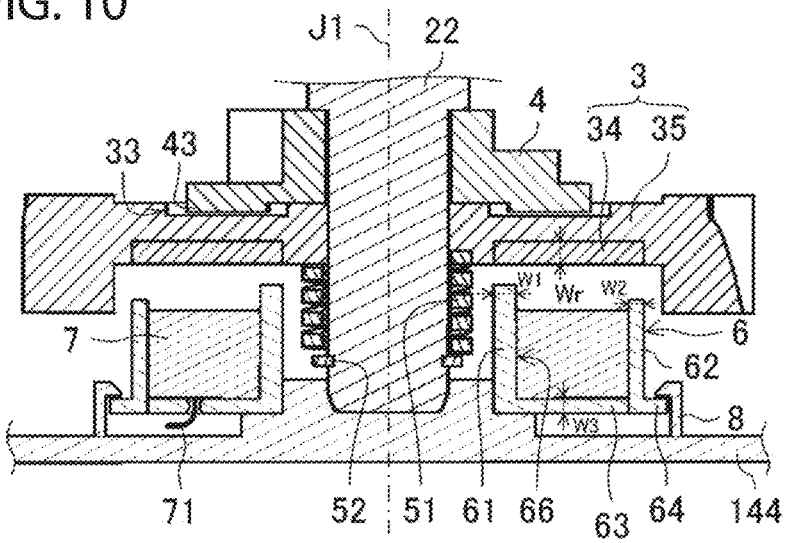
FIG. 10 is a cross-sectional view illustrating a configuration example of a worm wheel gear according to a modification example of the illustrative example embodiment of the present disclosure.

In the above-described example embodiment, the entire worm wheel gear 3 is the magnetic body. On the other hand, in a modification example of the example embodiment to be described below, a part of the worm wheel gear 3 is a magnetic body, and the remaining part is made of resin. That is, at least a part of the worm wheel gear may be a magnetic body. FIG. 10 is a cross-sectional view illustrating a configuration example of a worm wheel gear 3 according to the modification example of the example embodiment. Note that, hereinafter, configurations different from the configuration in the above-described example embodiment will be described. Further, the same components as those in the above-described example embodiment are designated by the same reference signs, and the description thereof may be omitted.

In the modification example, the worm wheel gear 3 further includes a magnetic body 34. The magnetic body 34 faces the yoke 6 in the vertical direction and extends in the circumferential direction. The magnetic body 34 has an annular shape surrounding the first axis J1 and has a plate shape expanding in the radial direction. In FIG. 10, a lower surface of the magnetic body 34 is exposed to the outside (that is, below) of the worm wheel gear 3. Note that, the present disclosure is not limited to the example of FIG. 10, and the lower surface of the magnetic body 34 may not be exposed. That is, the magnetic body 34 may be embedded in a magnetic body holding portion 35.

The worm wheel gear 3 further includes the magnetic body holding portion 35. The magnetic body holding portion 35 holds the magnetic body 34. The magnetic body holding portion 35 is made of resin. The magnetic body holding portion 35 is formed integrally with the magnetic body 34 by means such as insert molding. However, the present disclosure is not limited to this example, and the magnetic body 34 may be fixed in a recess that is disposed on a lower surface of the magnetic body holding portion 35 and is recessed upward by fixing means using an adhesive or the like.

The magnetic body 34 includes a contact surface in contact with the magnetic body holding portion 35 and an opposing surface facing the yoke 6 in the vertical direction. The contact surface is an upper surface, a radial outer surface, and a radial inner surface of the magnetic body 34, and the opposing surface is the lower surface of the magnetic body 34. Preferably, the surface roughness of the contact surface is greater than the surface roughness of the opposing surface. As the surface roughness, for example, arithmetic average roughness Ra, maximum height Ry, ten-point average roughness Rz, and the like can be used. By doing this, since the surface roughness of the contact surface can be further increased, a contact area between the magnetic body 34 and the magnetic body holding portion 35 can be increased, and an anchor effect at a connection portion between the magnetic body and the magnetic body holding portion can be further enhanced. Accordingly, adhesion and connection strength between the magnetic body 34 and the magnetic body holding portion 35 can be improved. Thus, the magnetic body holding portion 35 can more reliably hold the magnetic body 34. When both the magnetic body and the magnetic body holding portion are bonded by using an adhesive, a brazing material, or the like, the bonding strength can be improved. However, the above-described example does not exclude a configuration in which the surface roughness of the contact surface is equal to or less than the surface roughness of the opposing surface.

Next, in the modification example, the yoke 6 forms a magnetic circuit through which a magnetic flux generated by energization of the coil 7 passes together with at least a part (for example, the magnetic body 34) of the worm wheel gear 3. Preferably, a width Wr (that is, a thickness) of the magnetic body 34 in the vertical direction is equal to or greater than the widest width of the width W1 of the first yoke portion 61 in the radial direction, the width W2 of the second yoke portion 62 in the radial direction, and the width W3 of the third yoke portion 63 in the vertical direction. For example, in FIG. 10, since W1 is the widest, the thickness Wr of the magnetic body 34 is equal to or greater than W1. The thickness Wr of the magnetic body 34 is set to be equal to or greater than the widest width among W1, W2, and W3, and thus, magnetic flux leakage in the magnetic body 34 can be prevented. A material other than the magnetic body can be used for a portion other than the magnetic body 34 in the worm wheel gear 3. For example, when resin is used, since a weight of the worm wheel gear 3 can be further reduced, a weight of the lacing module 100 can be reduced. However, this example does not exclude a configuration in which the width Wr of the magnetic body 34 in the vertical direction is less than the widest width among W1, W2, and W3.

More preferably, a radial inner end of the magnetic body 34 overlaps with a radial inner end of the first yoke portion 61 or is on the radial inner side from the radial inner end of the first yoke portion 61 as viewed in the vertical direction. As viewed in the vertical direction, a radial outer end of the magnetic body 34 overlaps with the radial outer end of the second yoke portion 62, or is on the radial outer side from the radial outer end of the second yoke portion 62. By doing this, it is possible to prevent a decrease in a facing area between the first yoke portion 61 and the second yoke portion 62 and the worm wheel gear 3. Accordingly, since it is possible to prevent the magnetic circuit from being thinned at a facing portion, it is possible to prevent deterioration of the magnetic performance of the magnetic circuit. However, this example does not exclude a configuration in which the radial inner end of the magnetic body 34 is on the radial outer side from the radial inner end of the first yoke portion 61 and a configuration in which the radial outer end of the magnetic body 34 is on the radial inner side from the radial outer end of the first yoke portion 61 as viewed in the vertical direction.

The present disclosure is useful for a module for winding a string or unwinding a wound string and/or tightening or loosening a string.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A lacing module comprising:

a spool that includes a barrel portion around which a string is able to be wound, and a spool shaft portion extending along a first axis extending in a vertical direction;

a worm gear that is rotatable together with a shaft of a motor;

a worm wheel gear that meshes with the worm gear; and a clutch gear that is fixed to a radial outer end of the spool shaft portion, and is above the worm wheel gear;

wherein the spool shaft portion is rotatable about the first axis together with the barrel portion and the clutch gear;

the worm wheel gear includes a first gear through-hole extending along the first axis;

the spool shaft portion is inserted into the first gear through-hole;

one gear of the worm wheel gear and the clutch gear includes a protrusion, and the other gear includes a recess;

the protrusion is on a surface of the one gear opposing another gear of the worm wheel gear and the clutch gear, and protrudes from the one gear to the another gear in the vertical direction;

the recess is on a surface of the another gear opposing the one gear, and is recessed from the one gear to the another gear in the vertical direction; and at least an end of the protrusion protruding from the one gear to the another gear in the vertical direction is fitted into the recess.

2. The lacing module according to claim 1, further comprising:

an elastic portion in contact with a lower end of the worm wheel gear; wherein the elastic portion is capable of applying a load directed to the clutch gear to the worm wheel gear.

3. The lacing module according to claim 1, further comprising:

a yoke; and a coil that extends in a circumferential direction about the first axis; wherein the yoke and the coil are below the worm wheel gear;

at least a portion of the worm wheel gear and the yoke are magnetic bodies;

the yoke includes:

a first yoke portion on a radial inner side from the coil;

a second yoke portion on a radial outer side from the coil; and a third yoke portion below the coil and extending in the circumferential direction;

the first yoke portion and the second yoke portion have cylindrical shapes in the vertical direction; and a lower end of the first yoke portion and a lower end of the second yoke portion are connected to the third yoke portion.

4. The lacing module according to claim 3, wherein the first yoke portion is a portion different from a structure which includes the third yoke portion.

5. The lacing module according to claim 3, wherein an upper end of one yoke portion of the first yoke portion and the second yoke portion is above an upper end of the other yoke portion.

6. The lacing module according to claim 5, wherein a width of the one yoke portion in a radial direction is equal to or greater than a width of the third yoke portion in the vertical direction.

7. The lacing module according to claim 3, wherein the third yoke portion includes at least one yoke through-hole; and the yoke through-hole penetrates the third yoke portion in the vertical direction.

8. The lacing module according to claim 7, wherein the third yoke portion further includes a chamfered portion; and the chamfered portion is in at least one end of an upper end and a lower end of an inner surface of the yoke through-hole.

9. The lacing module according to claim 3, further comprising:

an insulating film including electrical insulation; wherein the insulating film covers at least a region opposing the coil on a surface of the yoke.

10. The lacing module according to claim 3, wherein the coil includes a gap with a radial outer surface of the first yoke portion in a radial direction.

11. The lacing module according to claim 3, wherein the coil includes a conductive wire wound around a radial outer surface of the first yoke portion.

12. The lacing module according to claim 3, wherein, in the vertical direction, a position of an upper end of the coil is at one of a same position as an upper end of the yoke and a position below the upper end of the yoke.

13. The lacing module according to claim 3, wherein the worm wheel gear includes a magnetic body that opposes the yoke portion in the vertical direction and extends in the circumferential direction; and a width of the magnetic body in the vertical direction is equal to or greater than a widest width of a width of the first yoke portion in a radial direction, a width of the second yoke portion in the radial direction, and a width of the third yoke portion in the vertical direction.

14. The lacing module according to claim 13, wherein as viewed in the vertical direction:

a radial inner end of the magnetic body overlaps with a radial inner end of the first yoke portion or is on a radial inner side from the radial inner end of the first yoke portion; and a radial outer end of the magnetic body overlaps with a radial outer end of the second yoke portion or is on a radial outer side from the radial outer end of the second yoke portion.

15. The lacing module according to claim 3, further comprising:

a plate portion that is below the yoke and expands in a radial direction; and at least one holder that holds the yoke; wherein the yoke further includes a yoke flange portion that expands to a radial outer side from a radial outer end of the second yoke portion; and the holder protrudes upward from the plate portion, and engages with the yoke flange portion.

16. The lacing module according to claim 1, wherein the spool shaft portion includes a first flat surface portion parallel or substantially parallel to the vertical direction;

the clutch gear includes:

a second gear through-hole that extends along the first axis; and a second flat surface portion that is on an inner surface of the second gear through-hole and is parallel to the vertical direction;

the spool shaft portion is inserted into the second gear through-hole; and the second flat surface portion opposes and is in contact with the first flat surface portion in a radial direction.

17. The lacing module according to claim 16, wherein the spool shaft portion further includes a contact surface portion in contact with an upper end of the clutch gear; and the contact surface portion is perpendicular or substantially perpendicular to the vertical direction, and is above the first flat surface portion.

18. The lacing module according to claim 1, further comprising:

an annular metal fitting in contact with a lower end of an elastic portion; wherein the elastic portion includes an opening penetrating in the vertical direction;

the spool shaft portion is inserted into the metal fitting and the opening of the elastic portion;

the spool shaft portion includes a groove that is recessed to a radial inner side and extends in a circumferential direction;

the groove is below the elastic portion at a lower portion of the spool shaft portion; and a radial inner end of the metal fitting is housed in the groove.

19. The lacing module according to claim 1, wherein, as viewed in a radial direction, the protrusion of the one gear of the clutch gear and the worm wheel gear and the recess of the another gear of the clutch gear and the worm wheel gear have tapered shapes in which widths in a direction perpendicular or substantially perpendicular to the vertical direction and parallel or substantially parallel to the radial direction become narrower from the one gear to the other gear in the vertical direction.

20. The lacing module according to claim 1, further comprising:

a limiting gear that is rotatable about a second axis parallel or substantially parallel to the first axis; wherein the limiting gear meshes with the clutch gear;

the clutch gear is an intermittent gear at which first teeth arranged in a circumferential direction are provided in a partial region on a radial outer surface in the circumferential direction;

the limiting gear includes:

second teeth arranged in the circumferential direction about the second axis;

a first limiting tooth arranged adjacent to the second tooth that is closest to one circumferential side in the circumferential direction; and a second limiting tooth arranged adjacent to the second tooth that is closest to the other circumferential side in the circumferential direction; and tooth thicknesses of the first limiting tooth and the second limiting tooth are larger than a width of a tooth groove between the first teeth adjacent in the circumferential direction of the clutch gear.

* * * * *